US006435339B1

(12) United States Patent
Kroupa

(10) Patent No.: US 6,435,339 B1
(45) Date of Patent: Aug. 20, 2002

(54) CONTACT LENS CASE WITH CLIP

(76) Inventor: Bob Kroupa, 1408 W. Warner, Chicago, IL (US) 60613

( * ) Notice: Subject to any disclaimer, the term of this patent is extended or adjusted under 35 U.S.C. 154(b) by 0 days.

(21) Appl. No.: 09/973,631

(22) Filed: Oct. 5, 2001

(51) Int. Cl.[7] ..... A45C 11/04
(52) U.S. Cl. ..... 206/5.1; 206/38
(58) Field of Search ..... 206/5.1, 223, 37.1, 206/37.5, 37.8, 38, 38.1; D3/208, 264

(56) References Cited

U.S. PATENT DOCUMENTS

| | | | | | |
|---|---|---|---|---|---|
| 3,052,246 | A | | 9/1962 | Beard | |
| D196,681 | S | * | 10/1963 | Middleton | D3/264 |
| 3,378,020 | A | | 4/1968 | Grabiel | |
| 3,460,552 | A | | 8/1969 | Sturgeon | |
| 3,524,455 | A | * | 8/1970 | Hoogesteger | 206/5.1 |
| 3,536,082 | A | | 10/1970 | Kolbeck | |
| 3,602,238 | A | | 8/1971 | Brown | |
| 3,643,672 | A | | 2/1972 | Brown | |
| 3,645,284 | A | * | 2/1972 | Krezanoski et al. | 206/5.1 |
| 3,661,248 | A | | 5/1972 | Isen | |
| 3,695,280 | A | | 10/1972 | Sturgeon | |
| 3,741,377 | A | | 6/1973 | Krellen | |
| 3,768,633 | A | | 10/1973 | Nathan | |
| 3,822,780 | A | | 7/1974 | Ulmer | |
| 3,977,517 | A | | 8/1976 | Kadlecik | |
| 4,036,357 | A | | 7/1977 | Czelen | |
| 4,328,890 | A | | 5/1982 | Thomas | |
| 4,415,076 | A | | 11/1983 | Campbell | |
| 4,765,459 | A | | 8/1988 | Edwards | |
| 4,784,258 | A | | 11/1988 | Figari | |
| 4,854,449 | A | | 8/1989 | Fitzhugh | |
| 5,000,204 | A | | 3/1991 | Smith | |
| 5,086,913 | A | | 2/1992 | Camm | |
| 5,383,550 | A | | 1/1995 | Tsao | |
| 5,415,275 | A | | 5/1995 | Girimont | |
| 5,452,792 | A | | 9/1995 | Zautke | |
| 5,676,243 | A | | 10/1997 | Sanders | |
| D388,602 | S | * | 1/1998 | Petruzzi | D3/208 |
| 5,881,867 | A | | 3/1999 | Tohill, Jr. | |
| 5,950,816 | A | | 9/1999 | Reid | |
| 6,244,430 | B1 | * | 6/2001 | Travis | 206/5.1 |
| 6,318,548 | B1 | * | 11/2001 | Travis | 206/5.1 |

FOREIGN PATENT DOCUMENTS

| | | | | |
|---|---|---|---|---|
| WO | WO 92/19123 | * | 11/1992 | 206/5.1 |

* cited by examiner

*Primary Examiner*—Luan K. Bui
(74) *Attorney, Agent, or Firm*—Lee, Mann, Smith, McWilliams, Sweeney & Ohlson

(57) ABSTRACT

The present invention relates to a compact case for storing contact lenses that is designed to be attachable to a key ring and can be stored within the contact wearers pocket without being obtrusive. The contact lens case includes two reservoirs that share a common circular bottom wall. The reservoirs are coaxially oriented and are threaded to accept cylindrical closure caps that seal the reservoirs. The cylindrical closure caps engage the opposite ends of the cylindrical body and have inner peripheral surfaces that are coaxially related to the outer peripheral surfaces of the two cylindrical reservoirs of the body. The contact lens case further comprises a tab that extends tangentially outward from the central axis of the reservoirs. The tab includes an aperture that is adapted to accept a removable clip that allows for attachment of the contact lens case to a key ring.

22 Claims, 3 Drawing Sheets

CONTACT LENS CASE WITH CLIP

BACKGROUND OF THE INVENTION

This invention relates generally to contact lens cases and more particularly to a novel contact lens case that is designed to provide an ultra-compact storage space for contact lenses and that can be connected to a key ring.

PRIOR ART

People who use contact lenses, whether of the rigid or soft variety, always need a contact lens case available to store their lenses when not in use. The reasons for the need to store lenses vary; unexpected overnight stays away from home; travel; activities where there is a need or likelihood for frequent contact lens removal and replacement; extended wear due to long office hours. The lens storage container must be able to hold contact lens solution and have a water-tight seal to prevent the loss of solution and to prevent outside contaminants from entering the case.

It is not uncommon for a contact lens wearer to get a foreign object in their eye, such as an eyelash or dirt particle, that causes irritation to the eye. In such cases, the contact lens must be immediately removed from the eye and cleaned, and then re-inserted into the eye or stored in a saline solution. If this type of situation occurs, and a contact case is not available, the contact wearer must find an alternative container in which to place the contact lens, such as a glass of water. While contact lens storage devices are relatively small and transportable, they are usually forgotten until an irritation emergency arises. The prior art contact storage devices do not provide a simple and effective way to ensure that a contact lens storage case will always be available when needed.

SUMMARY OF THE INVENTION

The present invention comprises a novel contact lense case that provides an ultra-compact storage container for storing contact lenses that can be readily attached to a key ring and placed within the contact lens wearer's pocket without being obtrusive. The contact lens case is designed so that it can be inexpensively molded out of a polymer such as polypropylene. The contact lens case includes two reservoirs that share a common circular bottom wall. The reservoirs are coaxially oriented and are threaded to accept cylindrical closure caps that seal the reservoirs from loss of fluid and the entry of contaminants. The cylindrical closure caps engage the opposite ends of the cylindrical body and have inner peripheral surfaces that are coaxially related to the outer peripheral surfaces of the two cylindrical reservoirs of the body.

The contact lens case further comprises a tab that extends tangentially outward from the central axis of the reservoirs. The tab includes an aperture that is adapted to accept a removable clip that allows for attachment of the contact lens case to a key ring. The coaxial orientation of the contact lens reservoirs reduces the overall size of the case by eliminating the flat rectangular platform used to mount the reservoirs in the typical lens storage devices. When the cylindrical closure caps fully engage their respective reservoir, the outer diameter of the contact lens case is no wider that the outer diameter of the caps. The overall configuration of the contact lens case creates an ultra-compact lens storage arrangement that allows the contact lens wearer to keep the case attached to their key ring so that the case is always available if the wearer desired to remove and store their lenses.

These and other aspects of this invention are illustrated in the accompanying drawings, and are more fully described in the following specification.

DETAILED DESCRIPTION OF THE INVENTION

While the present invention will be described fully hereinafter with reference to the accompanying drawings, in which a particular embodiment is shown, it is understood at the outset that persons skilled in the art may modify the invention herein described while still achieving the desired result of the invention. Accordingly, the description which follows is to be understood as a broad informative disclosure directed to persons skilled in the appropriate arts and not as limitations of the present invention.

The present invention is directed to a contact lens case that is designed to be ultra-compact so that it can be attached to a key ring and carried around in the contact lens wearer's pocket without discomfort. The contact lens case of the present invention is illustrated and described as attachable to a key ring, but is believed to have broad applications above and beyond the description of this preferred embodiment. The contact lens case can be used daily at home and is designed so that it can be carried around in case the contact lens wearer experiences difficulty with their lenses.

Figure 1:
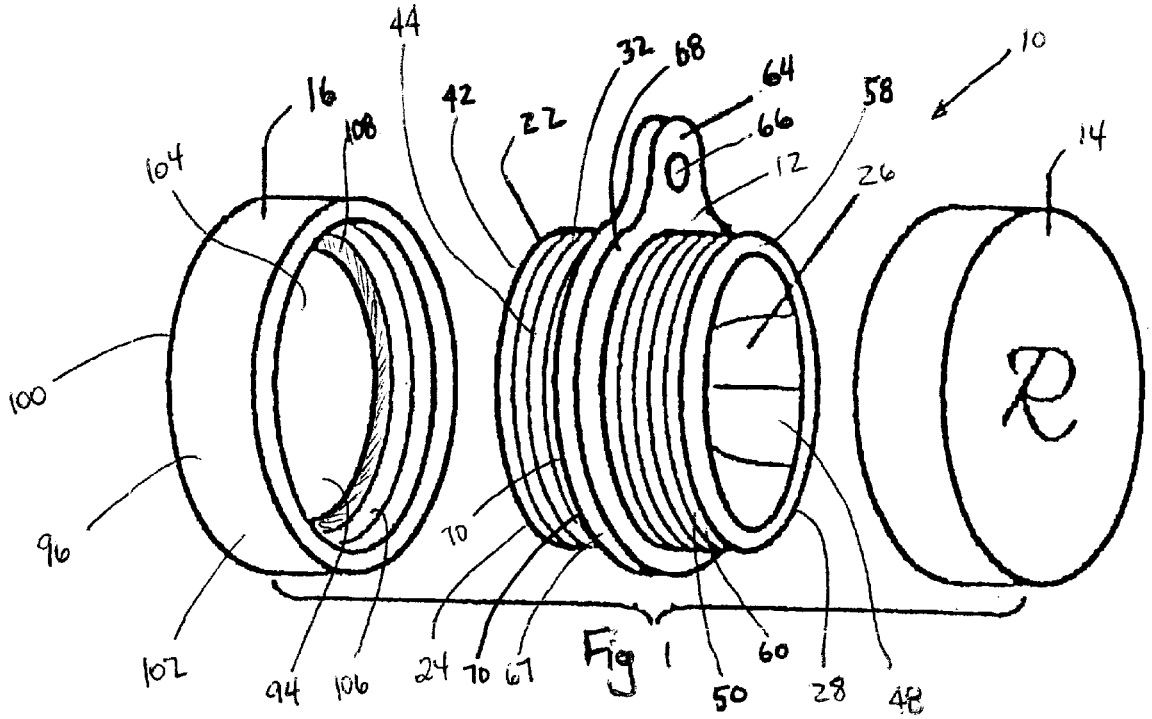
FIG. 1 is an exploded view of a contact lens case of the present invention showing the right and left cylindrical closure caps positioned over their respective contact lens storage reservoirs.
Figure 2:
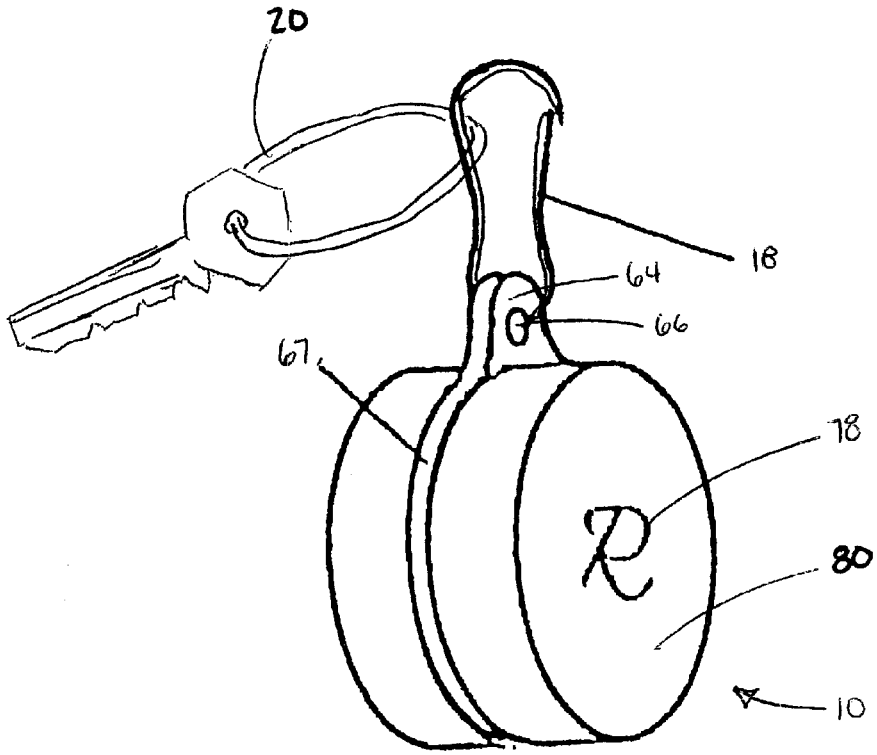
FIG. 2 is a perspective view of the contact lens case of the present invention presented fully assembled and illustrating a removable clip attached to the case.

FIG. 1 illustrates an exploded view of the contact lens case 10 of the present invention. The contact lens case 10 is comprised of a central cylinder 12, a right cylindrical closure cap 14, a left cylindrical closure capl 6, and a removable clip 18 for attachment to a key chain 20 as shown in FIG. 2. The clip 18 allows the contact case 10 to be removed from the key chain 20 and placed upon a flat surface so that the contact lenses can be easily added or removed from the case 10.

Figure 3:
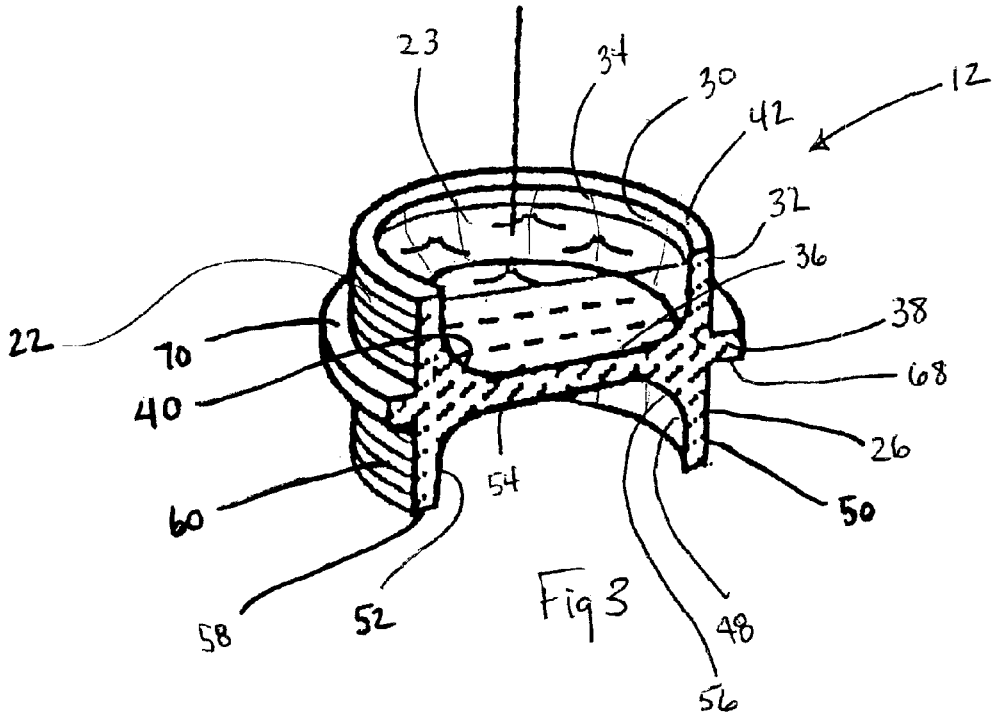
FIG. 3 is a perspective sectional view of the contact lens case of the present invention with one of the reservoirs filled with liquid.
Figure 4:
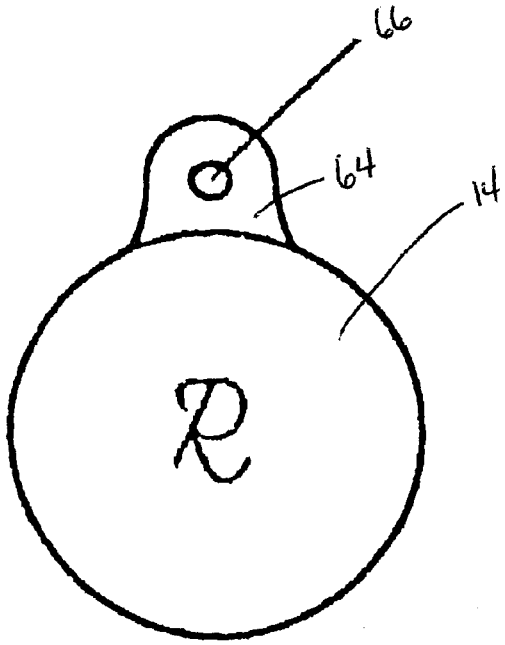
FIG. 4 is a front plan view of the contact lens case of the present invention showing the right cylindrical closure cap and an outwardly extending tab; and, FIG. 5 is a perspective view of an alternate embodiment of the contact lens case of the present invention showing the use of press type closure caps with retaining straps.
Figure 5:
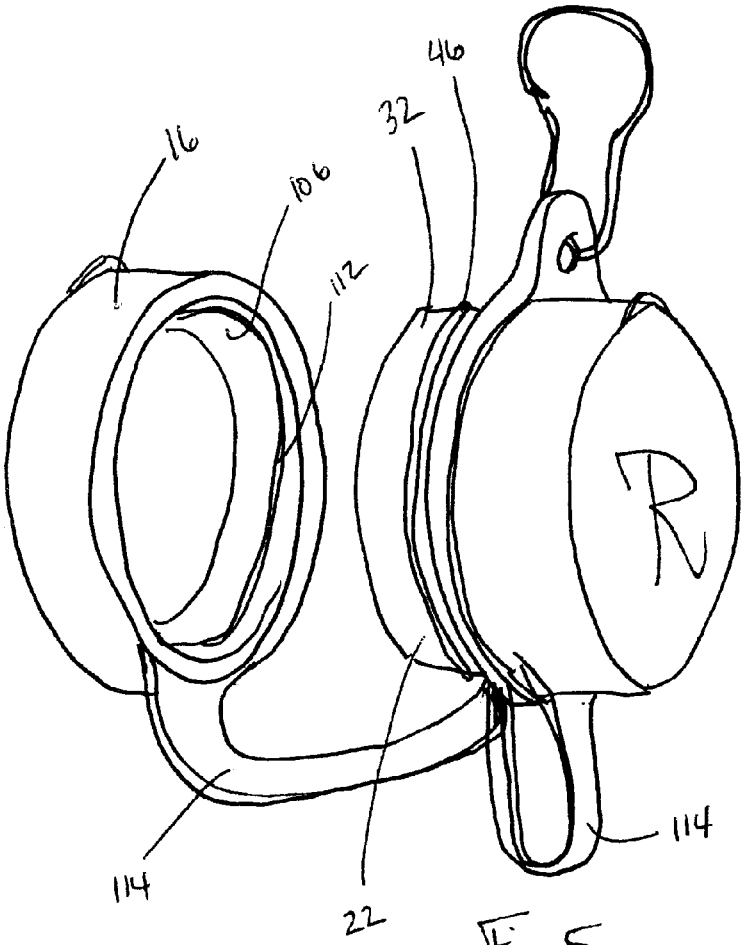

The central cylinder 12, as shown in FIG. 1, is comprised of a left reservoir 22 at a proximal end 24 and a right reservoir 26 at a distal end 28. The left reservoir 22 is coaxial to the right reservoir 26 and includes an inside surface 30 and an outside surface 32 as shown in FIG. 3. The inside surface 30 of the left reservoir 22 is concave and is adapted to hold a contact lenses storage fluid such as a saline solution 23. The left reservoir 22 has a side wall surface 34 and a bottom surface 36. The side wall surface 34 is curvilinear in shape and is embossed to prevent the contact lens from adhering to the wall surface 34. The side wall surface 34 may also include ribbing in place of the embossment which also spaces the contact lens away from the wall surface 34, preventing the adherence of the lens to the wall. The bottom surface 36 is part of a common bottom wall 38 shared with the right reservoir 26. The bottom surface 36 is relatively planar, and includes tapered edges 40 that transition into the side wall surfaces 34. The outside surface 32 of the left reservoir 22 includes an outer edge 42 that is adapted to contact the left closure cap 16 as shown in FIG. 1. The outside surface 32 further includes a machine thread 44 to allow the left closure cap 16 to be threaded onto the left reservoir 22 of the central cylinder 12. Alternatively, the outside surface 32 can utilize a smooth surface with a detent ring 46 so that the left closure cap 16 can be pressed onto the left reservoir 22 instead of threaded as shown in FIG. 5.

The right reservoir 26 is coaxial with the left reservoir 22 and includes an inside surface 48 and an outside surface 50 The inside surface 48 of the right reservoir 26 is concave and is adapted to hold a contact lens storage fluid such as a saline solution. The inside surface 48 of the right reservoir 26 has a side wall surface 52 and a bottom surface 54 as shown in FIG. 3. The side wall surface 52 is curvilinear in shape and is embossed to prevent the contact lens from adhering to the wall surface 52. The side wall surface 52 may also include ribbing in place of the embossment which is also designed to maintain the contact lens away from the wall surface 52, preventing adherence of the lens. The bottom surface 54 is part of the common bottom wall 38 shared with the left reservoir 22. The bottom surface 54 is relatively planar and includes tapered edges 56 that transition into the side wall surfaces 52. The outside surface 50 of the right reservoir 26 includes an outer edge 58 that is adapted to contact the right closure cap 14 as shown in FIG. 1. The outside surface 50 further includes a machine thread 60 to allow the right closure cap 14 to be threaded onto the right reservoir 26 of the central cylinder 12. Alternatively, the outside surface 50 can utilize a smooth surface with a detent ring (not shown) so that the right closure cap 14 can be pressed onto the right reservoir 26 instead of threaded.

The bottom wall 38 of the central cylinder 12, as shown in FIG. 1, connects the right reservoir 26 to the left reservoir 22 and includes a tab 64 with an aperture 66. The aperture 66 allows for the attachment of the clip 18 so that the contact lens case 10 can be connected to the key chain 20. The bottom wall 38 also has an extended cylindrical edge 67 that provides for secondary sealing surfaces 68 and 70 to prevent unwanted contaminants from entering the reservoirs 22 and 26. The sealing surfaces 68 and 70 may also include gasket rings (not shown) that aid in providing an air-tight seal.

Figure 6:
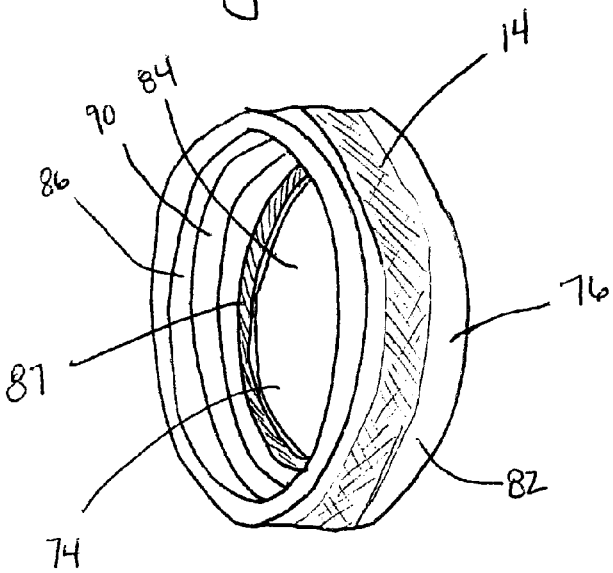
FIG. 6 is a perspective view of one of the closure caps for the contact lens case of the present invention.

The right closure cap 14, as shown best in FIGS. 1 and 6, is cylindrical in shape and is adapted to be connected to the right reservoir 26. The right closure cap 14 has an inside surface 74 and an outside surface 76. The outside surface 76 of the right closure cap 14 includes an indicator marking 78 on a back surface 80 which identifies the right side of the contact lens case 10 as shown in FIG. 2. The marking 78 preferably is in the shape of the capital letter "R," but other indicators can be used to identify the right reservoir 26. The outside surface 76 also includes a cylindrical side surface 82 that can be knurled or include a rubber insert to aid the user in removing the right closure cap 14. The inside surface 74 includes a top surface 84 and a side surface 86. The top surface includes a seal 87 to prevent the loss of contact lens solution from the right reservoir 26 when the right closure cap 14 is installed. The side surface 86 includes threads 90 that are adapted to engage the threads 60 of the right reservoir 26. If the detent ring 62 is used in place of the threads 60 on the reservoir 26, the side surface 86 of the right closure cap 14 includes a detent groove (not shown) to lock the right closure cap 14 to the reservoir 26.

The left closure cap 16, as shown in FIG. 1, is cylindrical in shape and is adapted to be connected to the left reservoir 22. The left closure cap 16 has an inside surface 94 and an outside surface 96. The outside surface 96 of the left closure cap 16 includes an indicator marking (not shown) on a back surface 100 which identifies the left side of the contact lens case 10. The marking is preferably in the shape of the capital letter "L," but other indicators can be used to identify the left reservoir 22. The outside surface 96 also includes a cylindrical side surface 102 that can be knurled or include a rubber insert to aid the user in removing the left closure cap 16. The inside surface 94 includes a top surface 104 and a side surface 106. The top surface 104 includes a seal 108 to prevent the loss of contact lens solution from the left reservoir 22 when the left closure cap 16 is installed. The side surface 106 includes threads 100 that are adapted to engage the threads 44 of the left reservoir 22. If the detent ring 46, shown in FIG. 5, is used in place of the threads 44 on the reservoir 22, the side surface 106 of the left closure cap 16 includes a detent groove 112 to lock the left closure cap 16 to the reservoir 22. If the alternative press on cap arrangement is used, the caps would include straps 114 that connect the right and left closure caps 14 and 16 to the bottom wall 38 of the central cylinder 12 to prevent loss.

Due to the orientation of the closure caps 14 and 16, the likelihood of placing the left contact lens in the right reservoir 26 and the right contact lens in the left reservoir 22 is greatly reduced, since when accessing the right reservoir 26, the left reservoir 22 and left closure cap 16 are facing the surface the contact lens case 10 is resting upon.

Various features of the invention have been particularly shown and described in connection with the illustrated embodiment of the invention, however, it must be understood that these particular arrangements merely illustrate the invention, and that the invention is to be given its fullest interpretation within the terms of the appended claims.

What is claimed is:

1. A contact case for storing lenses comprising:

a first reservoir parallel to a central axis having an outer surface;

a first cap removably attached to the outer surface of the first reservoir;

a second reservoir parallel to said central axis and coaxially oriented to said first reservoir, said second reservoir having an outer surface;

a second cap removably attached to the outer surface of the second reservoir;

a common wall extending in a radial direction from said central axis and beyond said first and second reservoirs, said common wall positioned between and connected to said first reservoir and said second reservoir; opposite sides of said common wall forming bottom surfaces of said first and second reservoirs.

2. The contact case of claim 1, wherein said outer surface of said first reservoir includes threads.

3. The contact case of claim 2, wherein said first cap has an inner surface that includes threads adapted to engage said threads of first reservoir.

4. The contact case of claim 1, wherein said outer surface of said second reservoir includes threads.

5. The contact case of claim 4, wherein said second cap has an inner surface that includes threads adapted to engage said threads of said second reservoir.

6. The contact case of claim 1, wherein said common wall includes an outwardly extending tab.

7. The contact case of claim 6, wherein said tab includes an aperture extending there-through.

8. The contact case of claim 7, wherein a clip is removably connected to the tab through the aperture.

9. A contact case for attaching to a key ring comprising:

a central wall having a first side, a second side and a radially outwardly extending tab, said tab having a clip adapted to be connected to the key ring;

a first fluid reservoir connected to said first side of said central wall;

a second fluid reservoir being coaxial with said first fluid reservoir;

a first cap removably attached to said first fluid reservoir; a second cap removably attached to said second fluid reservoir, and said central wall is extended beyond said first and second fluid reservoirs; opposite sides of said central wall forming bottom surfaces of said first and second fluid reservoirs.

10. The contact case of claim 9, wherein said first fluid reservoir includes a threaded outside surface.

11. The contact case of claim 10, wherein said first cap includes a threaded inside surface adapted to be connected to said threaded outside surface of said first fluid reservoir.

12. The contact case of claim 9, wherein said second fluid reservoir includes a threaded outside surface.

13. The contact case of claim 12, wherein said second cap includes a threaded inside surface adapted to be connected to said threaded outside surface of said second fluid reservoir.

14. The contact case of claim 9, wherein said clip is detachable.

15. A contact case for storing lenses comprising:

a central wall extending in a radial direction, said central wall having a first side and a second opposite side;

a first fluid reservoir connected to said first side of said central wall, a first cap removably attached to said first fluid reservoir;

a second fluid reservoir coaxial to said first fluid reservoir and connected to said second opposite side of said central wall, a second cap removably attached to said second fluid reservoir;

said first side and said second opposite side of said central wall comprising bottom surfaces of said first and second reservoirs respectively, and said radial direction of said central wall is extended beyond said first and second fluid reservoirs.

16. The contact case of claim 15, wherein said first fluid reservoir includes a threaded outside surface.

17. The contact case of claim 16, wherein said first cap includes a threaded inside surface adapted to be connected to said thread outside surface of said first fluid reservoir.

18. The contact case of claim 15, wherein said second fluid reservoir includes a threaded outside surface.

19. The contact case of claim 18, wherein said second cap includes a threaded inside surface adapted to be connected to said threaded outside surface of said second fluid reservoir.

20. The contact case of claim 15, wherein said central wall includes an outwardly extending tab.

21. The contact case of claim 20, wherein said tab includes an aperture adapted to accept a removable clip.

22. The contact case of claim 20, wherein said tab includes an aperture adapted to accept a removable clip connected to a key chain.

* * * * *